US009227708B2

(12) United States Patent
Bleicken

(10) Patent No.: US 9,227,708 B2
(45) **Date of Patent: *Jan. 5, 2016**

(54) CIRCUMFERENTIAL RING PROPULSORS AND CONTROL ASSEMBLIES FOR MANNED OR UNMANNED UNDERWATER VEHICLES

(71) Applicant: Eric Bleicken, Portland, ME (US)

(72) Inventor: Eric Bleicken, Portland, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/082,863

(22) Filed: Nov. 18, 2013

(65) Prior Publication Data

US 2014/0299034 A1 Oct. 9, 2014

Related U.S. Application Data

(63) Continuation of application No. 12/806,061, filed on Aug. 5, 2010, now Pat. No. 8,585,451.

(51) Int. Cl.

| | |
|---|---|
| ***B63H 5/07*** | (2006.01) |
| ***B63H 21/17*** | (2006.01) |
| ***B63G 8/08*** | (2006.01) |
| ***B63G 8/16*** | (2006.01) |
| ***B63H 1/16*** | (2006.01) |
| ***B63H 5/10*** | (2006.01) |
| ***B63H 5/14*** | (2006.01) |
| ***B63H 25/48*** | (2006.01) |
| ***F42B 19/01*** | (2006.01) |
| ***F42B 19/12*** | (2006.01) |
| *B63H 23/00* | (2006.01) |

(52) U.S. Cl.

CPC .. *B63G 8/08* (2013.01); *B63G 8/16* (2013.01); *B63H 1/16* (2013.01); *B63H 5/10* (2013.01); *B63H 5/14* (2013.01); *B63H 25/48* (2013.01); *F42B 19/01* (2013.01); *F42B 19/12* (2013.01); *B63H 2023/005* (2013.01)

(58) Field of Classification Search

CPC ..... B63G 8/08; B63G 8/16; B63H 1/16; B63H 25/48; B63H 5/10; B63H 5/14; B63H 2023/005; F42B 19/01; F42B 19/12

USPC ..... 114/20.1, 23, 321, 330, 337, 338; 415/129; 440/79, 6, 66

See application file for complete search history.

(56) References Cited

U.S. PATENT DOCUMENTS

| | | | | | |
|---|---|---|---|---|---|
| 2,094,997 | A | * | 10/1937 | Lucich | 114/20.1 |
| 2,727,485 | A | * | 12/1955 | Combs | 114/321 |
| 3,101,066 | A | * | 8/1963 | Haselton | 114/330 |
| 3,291,086 | A | * | 12/1966 | Haselton | 114/330 |

(Continued)

*Primary Examiner* — Anthony Wiest

(74) *Attorney, Agent, or Firm* — Caseiro Burke, LLC; Chris A. Caseiro

(57) ABSTRACT

A propulsor and control system for an underwater vehicle having annular fore and aft circumferential shrouds surrounding the hull. The fore and aft circumferential shrouds form respective fore and aft circumferential shroud gaps between the fore and aft circumferential shrouds and the hull. Fore and aft propulsor blades are situated substantially or completely within the fore and aft circumferential shroud gaps; the blades counter-rotate in one preferred embodiment. The fore or aft circumferential ring propulsors can have front control vanes located in front of the respective propulsors blade sets, and back control vanes located behind the respective propulsors to control the direction of the flow of water in order to maneuver the underwater vehicle.

15 Claims, 4 Drawing Sheets

(56) References Cited

U.S. PATENT DOCUMENTS 4,648,345 A * 3/1987 Wham et al. ..... 114/338
5,028,210 A * 7/1991 Peterson et al. ..... 416/164
5,078,628 A * 1/1992 Garis, Jr. ..... 440/6
5,445,105 A * 8/1995 Chen et al. ..... 114/338
5,702,273 A * 12/1997 Cho et al. ..... 440/6
6,280,284 B1 * 8/2001 Winefordner et al. ..... 446/162
7,841,290 B1 * 11/2010 Reitz et al. ..... 114/337
8,074,592 B2 * 12/2011 Schroder ..... 114/338

* cited by examiner

CIRCUMFERENTIAL RING PROPULSORS AND CONTROL ASSEMBLIES FOR MANNED OR UNMANNED UNDERWATER VEHICLES

CROSS-REFERENCE TO RELATED APPLICATIONS

This is a continuation application and claims the priority of U.S. application Ser. No. 12/806,061 filed Aug. 5, 2010, now U.S. Pat. No. 8,585,451, issued Nov. 19, 2013. The entire content of the priority application is incorporated herein by reference.

STATEMENT REGARDING FEDERALLY SPONSORED RESEARCH OR DEVELOPMENT

None.

THE NAMES OF THE PARTIES TO A JOINT RESEARCH AGREEMENT

None

REFERENCE TO A "SEQUENCE LISTING"

Not applicable.

BACKGROUND OF THE INVENTION (1) Field of the Invention

This invention relates to a propulsor system and control assembly for underwater vehicles such as submarines or small manned or unmanned underwater vehicle.

(2) Description of the Prior Art

The following is a tabulation of some of the prior art that appears relevant:

U.S. Patent Documents

| | | |
|---|---|---|
| 2,094,997 | October 1937 | Lucich |
| 2,727,485 | December 1955 | Combs |
| 3,101,066 | August 1963 | Haselton |
| 4,648,345 | March 1987 | Wham |
| 5,078,628 | January 1992 | Garis |
| 5,445,105 | August 1995 | Chen |
| 5,702,273 | December 1997 | Cho |
| 6,280,284 | August 2001 | Winefordner |

Underwater vehicles have traditionally been driven by propellers. From torpedoes to submarines, nearly all have used a central shaft with hub mounted blades radiating outward that provide thrust for forward or reverse motion. Maneuvering and control of underwater vehicles is made with a system of rudders and diving planes protruding from the vessel's hull. However, for the rudders and diving planes to function, water must flow across their surfaces; therefore, forward or reverse speed must be maintained in order to maneuver making maneuvering in a hovering mode difficult if not impossible.

Propellers exhibit other problems peculiar to clandestine and/or covert underwater operations:

Cavitation—Propellers under high load produce "cavitation", that is to say bubbles produced in the water from reduced pressure. Cavitation reduces efficiency and creates unwanted noise.

Turbulence—Propellers produce turbulence aft (i.e., at or near the stem) of a submarine thus creating a "blind zone" for the submarine's sonar and a vulnerability to enemy submarine attack.

Hull penetration—Propellers require penetration of a submarine pressure hull by a propeller shaft protruding through a packing gland under high hydrostatic pressure. This is an undesirable engineering weakness.

Susceptibility to physical damage—Even a slight ding creates noise that can reveal a submarines location to a vigilant enemy. Propellers are highly susceptible to physical damage.

With advances in technology and the broadening of requirements for underwater vehicles, there is a growing need for systems that can operate over longer distances and at increased speeds. In addition, it is highly desirable that underwater vehicles are able hover and maneuver with no way on (i.e., not going forward or backward). Of particular interest is a means for launching and recovering manned and unmanned underwater vehicles from a host submarine operating underwater. Given the conditions of darkness or turbidity as well as the surge caused by wave action from above, it is critical that smaller underwater vehicles be capable of maneuvering in a hovering or near hovering mode. Particular past prior art is discussed below in order to identify their differences with the present invention:

| | | |
|---|---|---|
| 2,094,997 | October 1937 | Lucich |

Propelling Mechanism for Torpedoes is a pair or multiple pairs of counter-rotating, gear driven blades, radiating outward along the center section of the torpedo body. Control of elevation and steerage is managed by horizontal planes and rudders mounted at the rear of the torpedo.

The torpedo is propelled forward only and maneuvering is accomplished only when the torpedo is underway and water is passing over the control surfaces. There are also no shrouds for the propeller blades. The present invention provides both forward and reverse motion as well as total maneuvering control in the absence of forward or reverse way.

| | | |
|---|---|---|
| 2,727,485 | December 1955 | Combs |

Submarine Type Sea Train is a barge-like enclosed vessel designed with minimum freeboard to be towed with a forward motion, end-to-end. It has two counter-rotating sets of blades (four blade sets in total) that radiate outward from the fore and aft sections. Two sets of blades are in the fore section and two sets of blades are in the aft section. No steering control is provided as it is designed to be towed end to end in train-like fashion. There are also no shrouds for the propeller blades. Propulsion is in many ways, similar to Lucich (above) and lacks the forward, sternway and stationary control exhibited by the present invention.

| | | |
|---|---|---|
| 3,101,066 | August 1963 | Haselton |

Submarine Hydrodynamic Control System provides variable pitch blades for twin circumferential propulsory. Haselton lacks a shroud and exhibits a complex mechanical system. Hazelton is fundamentally different from the present invention as water is directed radially, or away from the hull, while maneuvering in a hovering mode, which would explain its lack of a shroud. In the alternative, the present invention redirects the water stream at right angles to the cross sectional radius of the underwater vessel with control vanes mounted within the annular gap.

Functionally, in Haselton, to maneuver the vessel's bow to starboard, the fore circumferential ring propulsor would direct water away from the hull on the port side. In the present invention however, to maneuver the vessel's bow to starboard, control vanes at the top and bottom of the fore circumferential ring propulsor would direct the water stream to port (or substantially to port).

As presented, Haselton is especially vulnerable to fouling from suspended debris in the water as well as naturally occurring ocean plant and animal life due to its lack of shrouds to protect the propeller blades. Furthermore, the propeller blades in Haselton are extremely vulnerable to damage from collision with the bottom or hard surfaces during close quarter maneuvers because there is no protective shroud as in the present invention. In Haselton, there are also no control vanes as in the present invention to control the maneuvering of the underwater vehicle. It is noteworthy that the Naval Surface Warfare Center, Carderock Division, West Bethesda, Md. 20817 recently examined Haselton more closely: see Benjamin Y.-H. Chen, Stephen K. Neely, Kurt A. Junghans and David P. Bochinski; *A Feasibility Study of a Novel Propulsion System for Unmanned Underwater Vehicles* (Presented at UDT Europe 2008 symposium, Glasgow, UK, Jun. 10-12, 2008. Benjamin Y.-H. Chen, Stephen K. Neely, Seth D. Schroeder, David P. Bochinski and Tyler W. Sullivan; *Analysis and Refinement of a Novel Propulsion System for Unmanned Underwater Vehicles* (Presented at UDT Europe 2009 symposium, Cannes, France, Jun. 9-11, 2009)

| | | |
|---|---|---|
| 4,648,345 | March 1987 | Wham |

Propeller System with Electrically Controlled Cyclic and Collective Blade Pitch is essentially the same as Haselton providing variable pitch blades for twin circumferential propulsors. However, where Haselton is mechanically controlled, Wham uses an electromagnetic approach to both drive the propulsor as well as control the pitch of the propulsor blades.

Like Haselton, Wham is fundamentally different from the present invention as water is directed radially, or away from the hull, while maneuvering in a hovering mode, which would explain its lack of a shroud. In the alternative, the present invention redirects the water stream at right angles to the radius with control vanes mounted within the annular gap. Wham also lacks control vanes.

| | | |
|---|---|---|
| 5,078,628 | January 1992 | Garis |

Marine Propulsor is a single circumferential, fixed blade propulsor mounted on a torpedo like underwater vehicle. Garis appears to provide forward propulsion only, and vertical plane and steering authority depend on the vehicle's forward speed through the water and are controlled by the rudder and vertical control surfaces at the stern. Garis does not provide any means for controlled maneuvering in place. There is no shroud and no control vanes as in the present invention.

| | | |
|---|---|---|
| 5,445,105 | August 1995 | Chen |

Torque Balanced Postswirl Propulsor Unit and Method for Eliminating Torque on a Submerged Body provides to counter-rotating propulsors at the stern of a torpedo like underwater vehicle. Both are driven by a central drive shaft (not a circumferential hub) and therefore, not similar to the present invention. There are also no shrouds. It has diving planes and a rudder but no control vanes as in the present invention.

| | | |
|---|---|---|
| 5,702,273 | December 1997 | Cho |

Marine Propulsion System for Underwater Vehicles is a fixed blade, shaft mounted propulsor that is electro-magnetically driven. Cho is only designed for forward motion of a torpedo like underwater vehicle. It does not hover or maneuver as in the present invention. Cho also has a central drive shaft for its propeller blades unlike the annular circumferential propulsor of the present invention. Cho also lacks a plurality of counter-rotating circumferential propulsors as exists in the present invention.

| | | |
|---|---|---|
| 6,280,284 | August 2001 | Winefordner |

Toy Submarine with Counter Rotating Propellers is a child's rubber band powered, free flooding toy with a split body and fixed blades extending from the forward and after sections. There is no vertical plane and steering authority in either an underway or stationary condition. This prior art is not similar to the present invention as there are no shrouds and no annular circumferential ring propulsors.

BRIEF SUMMARY OF THE INVENTION

This invention is for underwater vehicles such as manned submarines or smaller unmanned underwater vehicles. In one of the embodiments, the present invention is directed toward a circumferential ring propulsor and control assembly consisting of a plurality of annular circumferential ring propulsors capable of rotating in opposite directions (but not always rotating in opposite directions such as at maneuvers with no way forward or sternway). In one embodiment, one circumferential ring propulsor is fore of midships and one circumferential ring propulsor is aft of midships, and each of the circumferential ring propulsors are covered by its own shroud. In embodiment, control vanes are placed before and after the propulsor blade sets in order to maneuver the underwater vehicle. The control vanes may be adjusted individually to direct the flow of water in different directions so as to allow for directing and maneuvering of the underwater vehicle.

In one preferred embodiment of the invention, the power source and mechanical elements such as control vane actuators are housed within the underwater vehicles hull.

In one preferred embodiment of the invention, the power source and mechanical elements such as control vane actuators are housed within the shroud and outboard (i.e., in a lateral direction from the hull) of the annular gaps.

The embodiments discussed in this summary section do not represent the only embodiments of this section.

The Circumferential Ring Propulsors and Control Assemblies for Manned and Unmanned Underwater Vehicles is comprised of a two counter-rotating circumferential propulsors and control vanes operating between shrouds and the underwater vehicle's hull.

Propulsor blade sets operate in the annular gaps between shrouds surrounding the hull, forward and aft of midships. The shrouds may, or may not, contain part or all of the power source for the propulsor as well as actuator mechanisms for the control vanes. Shrouds also provide protection against propeller blade damage and fouling, and improve propulsive thrust characteristics. The two propulsor assemblies counter-rotate in order to neutralize torque from the propulsors on the underwater vehicle.

Control Vanes are placed between the propulsor shrouds and the hull to direct the flow of water through the forward and aft propulsors to provide both vertical plane and horizontal steering authority. Because these control vanes use the flow of both the forward and after propulsion assemblies, a greater degree of response is anticipated, as well as forces that can be varied independent of attitude or heading change. It is expected that this will give an improved standard of over-all craft controllability. The system will also eliminate the need for protruding diving planes and rudders, thus reducing the probability of fouling or damage due to bottom contact or collision with objects.

The proposed propulsor blade sets acting in consort with control vanes fore and aft of the propulsor blades provide an opportunity for improved interaction between the propulsor and hull resulting in greater speed, improved range, and quieter operations. Cavitation and turbulence should be greatly reduced. Additionally, operating mechanisms and controls are external to the system's interior, requiring no hull penetrations and leaving the interior space for payload. Because the propulsor blades and control vanes are protected by a shroud, their susceptibility to damage is greatly reduced.

At low speed rotation of the propulsors, a hovering mode can be accomplished by powering the forward and aft propulsors in opposite directions. By activating the control vanes, maneuvers of any kind, within a three dimensional underwater space becomes achievable: sideways, vertical, rotation in place, or maintaining any angular attitude. Thus, controlled maneuvering within a confined space such as the U S Navy's Dry Deck Shelter, a submarine missile tubes or in and around submerged obstructions and structures, becomes possible. This capability opens the way for both manned and unmanned underwater systems to conduct new and highly specialized military or commercial operations.

Of particular importance is the fact that all the propulsion mechanical systems are mounted outside the underwater vehicle's pressure hull. By comparison with existing manned and unmanned underwater vehicles that require much of their internal space to house batteries, motors and control equipment, the external configuration of the present invention frees the interior space for transporting electronics, mission payload, or personnel. Consequently, volumetric efficiency is high, and the distribution of payload to facilitate trim can be considerably more flexible.

Power for the invention may be provided from a broad range of sources depending on the needs and requirements of the user community. Diesel, nuclear, hydrogen, and electric are but a few and may be stored or generated on board the underwater vessel or supplied through a tether.

BRIEF DESCRIPTION OF THE SEVERAL VIEWS OF THE DRAWINGS

Reference is made to the accompanying drawings in which are shown illustration embodiments of the invention from which its novel features and advantages will be apparent in the drawings.

Two fundamental designs alternatives are likely, in which (a) all mechanical elements are housed within the shroud and outboard (i.e., in a lateral direction from the hull) of the annular gaps as seen in FIG. 2, FIG. 3, FIG. 4 and FIG. 5; and (b) all mechanical elements are imbedded in the underwater vehicle hull and inboard of the annular gaps as seen in FIG. 6, FIG. 7, FIG. 8 and FIG. 9.

DETAILED DESCRIPTION OF THE DRAWINGS

The present invention is directed to circumferential ring propulsors and control assemblies for manned or unmanned underwater vehicles. What follows constitutes a description of some of the embodiments of the invention. This detailed description of the drawings is not meant not limit the scope of the claims to the embodiments herein described.

Figure 1:
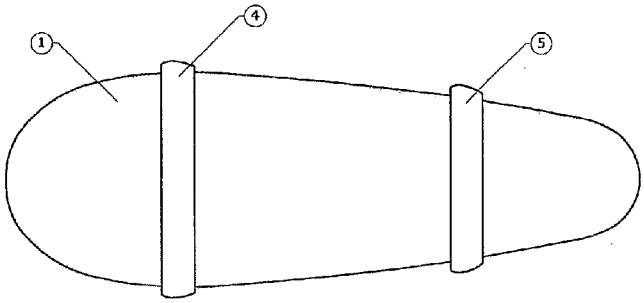
FIG. 1 is a side elevation of the underwater vehicle showing the general location of the fore and aft circumferential ring propulsor and control assemblies.

As can be seen in FIG. 1, there is a plurality of circumferential shrouds consisting of a fore-circumferential shroud (4) and an aft-circumferential shroud (5) that surround the fore circumferential ring propulsor and control assembly (2) and aft circumferential ring propulsor and control assembly (3). In one embodiment of the invention, both the fore-circumferential shroud (4) and the aft-circumferential shroud (5) are substantially or completely annular and surround the hull (1) of the underwater vehicle.

Figure 2:
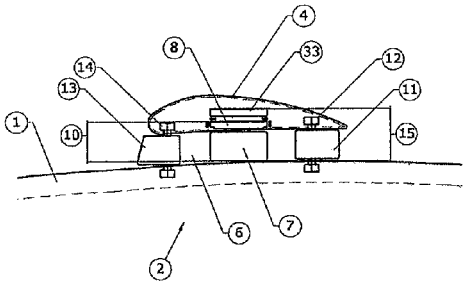
FIG. 2 is a side, cross-sectional view of the fore circumferential ring propulsor with the power source, propulsor assembly and control vanes mounted within the shroud and outboard of the underwater vehicle hull.
Figure 6:
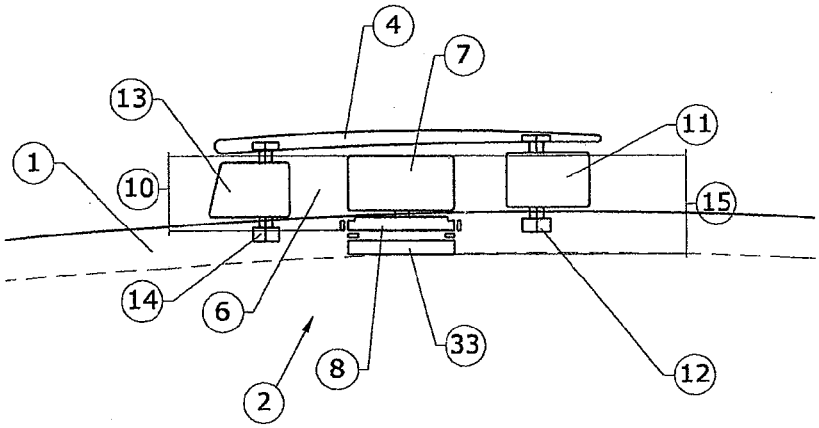
FIG. 6 is a cross-sectional view of the fore circumferential propulsor and control assembly wherein the power source and drive assembly are located within the underwater vehicle hull.

As can be seen in both FIG. 2 and FIG. 6, cross-sectional views of the fore circumferential ring propulsor, the fore-circumferential shroud (4) forms a fore-circumferential shroud gap (6) between the fore-circumferential shroud (4) and the hull (1). In one embodiment of the invention, the fore-circumferential shroud gap (6) is substantially or completely annular.

Figure 3:
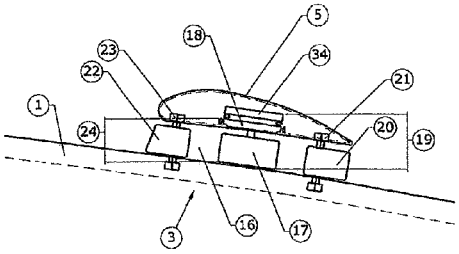
FIG. 3 is a cross-sectional view of the aft circumferential ring propulsor with the power source, propulsor assembly and control vanes mounted within the shroud and outboard of the underwater vehicle hull.
Figure 7:
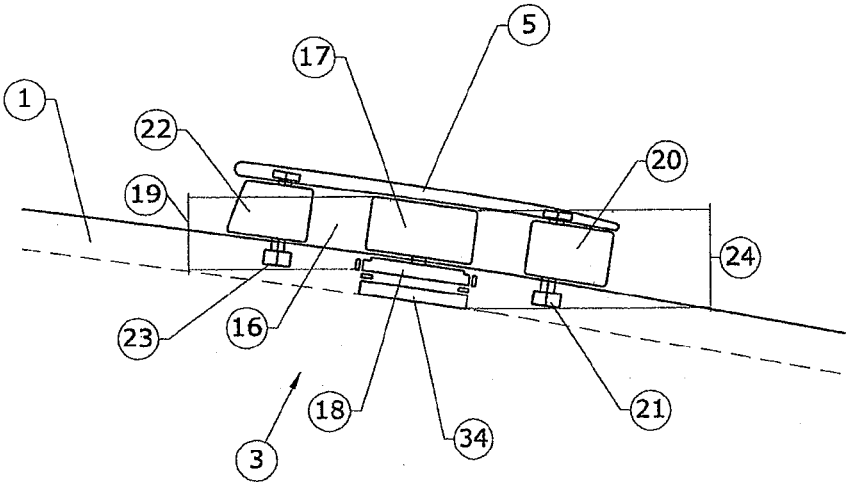
FIG. 7 is a cross-sectional view of the aft circumferential ring propulsor and control assembly wherein the power source and drive assembly are located within the underwater vehicle hull.

As can be seen in FIG. 3 and FIG. 7, cross-sectional views of the aft circumferential ring propulsor, the aft-circumferential shroud (5) forms an aft-circumferential shroud gap (16) between the aft-circumferential shroud (5) and the (1) hull. In one embodiment of the invention, the aft-circumferential shroud gap (16) is substantially or completely annular.

As can be seen in both FIG. 2 and FIG. 6, cross-sectional views of the fore circumferential ring propulsor, fore-propulsor blades (7) are situated within the fore-circumferential shroud gap (6) substantially or completely between the fore-circumferential shroud (4) and the hull (1).

Figure 4:
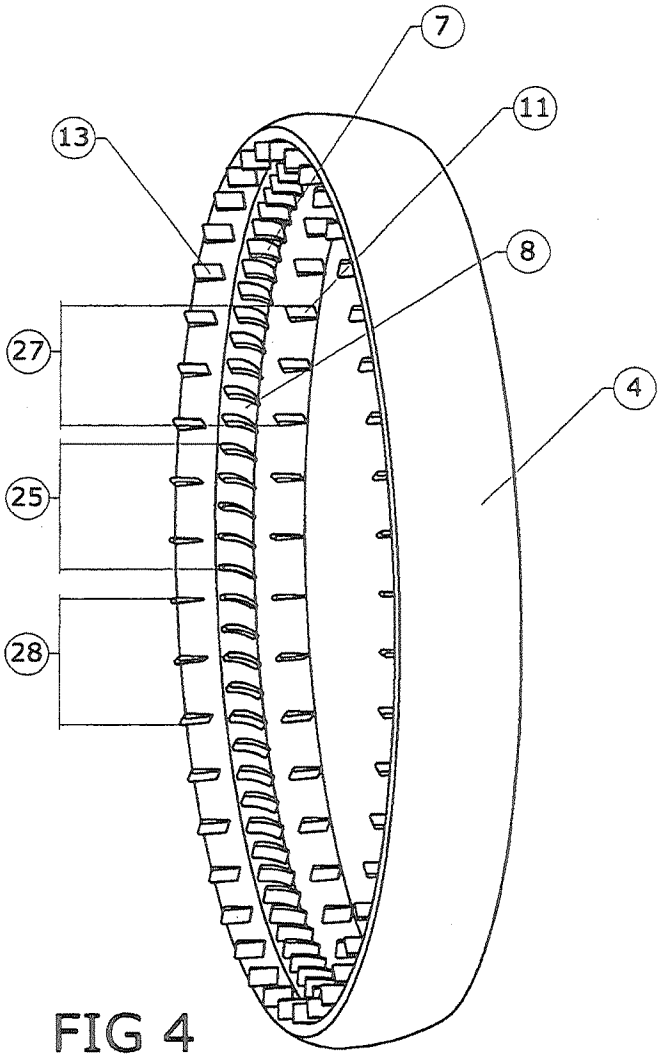
FIG. 4 is a perspective view of the fore circumferential ring propulsor and control assembly showing the positioning of the propulsor blades and fore and aft control vanes mounted within the shroud. (The underwater vessel's hull is not shown.)

As seen in FIG. 4, the perspective view of the fore circumferential ring propulsor and control assembly, the fore-propulsor blades (7) form a fore-propulsor blade set (25). The fore propulsor blade set (25) mounted on the fore propulsor hub (8) comprise the fore propulsor hub assembly (10) as seen in FIGS. 2 and 6.

Figure 9:
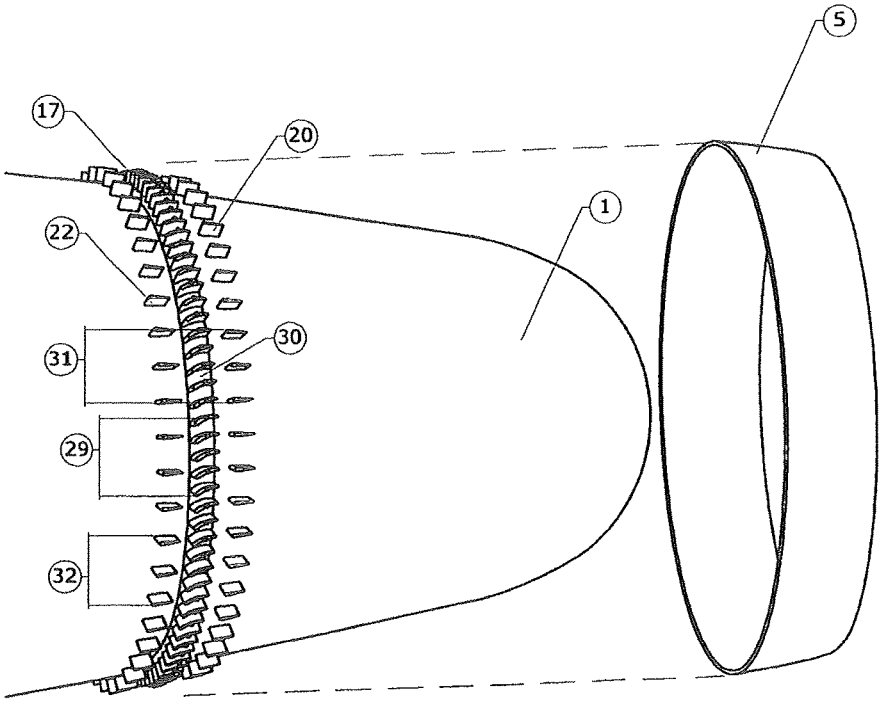
FIG. 9 is an exploded, perspective view of the aft circumferential ring propulsor and control assembly with the aft shroud offset in order to display the propulsor blades and control vanes that are mounted and controlled within the body of the underwater vehicle.

As can be seen in FIG. 3 and FIG. 7, cross-sectional views of the aft circumferential ring propulsor, aft-propulsor blades (17) are situated within the aft-circumferential shroud gap (16) substantially or completely between the aft-circumferential shroud (5) and the hull (1). Said aft propulsor blade set (29) as seen in FIG. 5 and FIG. 9 are mounted on the aft propulsor hub (18) and comprise the aft propulsor hub assembly (19) as seen in FIG. 3 and FIG. 7.

Figure 5:
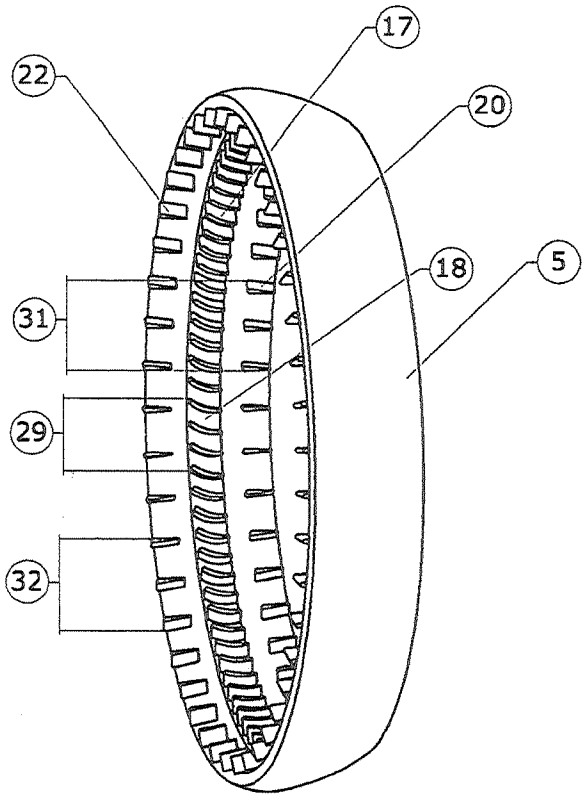
FIG. 5 is a perspective view of the aft circumferential ring propulsor and control assembly showing the positioning of the propulsor blades and fore and aft control vanes mounted within the aft shroud. (The underwater vessel's hull is not shown.)

As seen in FIG. 5, the perspective view of the aft circumferential ring propulsor and control assembly, the aft-propulsor blades (17) form an aft-propulsor blade set (29).

As can be seen in FIG. 3 and FIG. 7, cross-sectional views of the aft circumferential ring propulsor, aft-back-control vanes (20) are located behind the aft-propulsor blades (17). The position of the aft-back-control vanes (20) may be adjusted to direct the flow of water from the aft-propulsor blade (17) and control horizontal and vertical steering authority. In one embodiment of the invention, the aft-back-control vanes (20), that are individually connected to the aft-back vane control actuator (21), are located behind the aft-propulsor blades set (29) [as shown in the perspective view of FIG. 5, of the aft circumferential ring propulsor and control assembly] and are substantially or completely within the aft-circumferential shroud gap (16) [as shown in FIGS. 3 and 7]. In FIG. 5, the perspective view of the aft circumferential ring propulsor and control assembly, it can also be seen that the position of the aft-back-control vanes (20) may be adjusted to direct the flow of water from the aft-propulsor blade set (29) [formed from the collection of aft-propulsor blades (17)] and control horizontal and vertical steering authority.

The fore-propulsor blade set 25 [formed from the collection of fore propulsor blades 7] as shown in FIG. 4 and the aft-propulsor blade set [formed from the collection of aft propulsor blades 7] as shown in FIG. 5 usually rotate in opposite directions. While the circumferential ring propulsors (2 and 3) are not explicitly shown in FIG. 1 [they are shown in FIGS. 2 and 3 respectively], the circumferential ring propulsors (in one embodiment of the invention) are substantially or completely underneath the shrouds and are housed by the shrouds and run parallel with the shrouds. FIG. 1, which shows the side elevation of the underwater vehicle, shows the general location of the fore and aft shrouds (4 & 5) and indicates (without explicitly showing) the general location for the fore and aft circumferential ring propulsor sets (25 & 29) and the accompanying control vane sets (25,27,29, 31), because the propulsor sets (25 & 29) and control vane sets (20, 27,28,31, 32) are substantially or completely beneath the shrouds (4 & 5), in one of the preferred embodiments of the invention. In one of the preferred embodiments of the invention, the fore propulsor blade set (25) and the aft propulsor blade set (29) are capable of rotating in opposite directions, especially when the underwater vehicle is underway. In some tight maneuvering situations at low speed, the fore propulsor blade set (25) and the aft propulsor blade set (29) that are mounted on the fore and aft blade set hubs (26) and (30) may rotate in the same direction.

As shown in FIG. 1, in one of the preferred embodiments of the invention, the fore-circumferential shroud (4) is situated forward of midships, and aft-circumferential shroud (5) is locate aft of midships. In one of these preferred embodiments, the fore propulsor blade set (25) and the fore control vane sets (27 & 28) are located fore of midships [underneath the fore shroud 4), and the aft propulsor blade set (29) and the aft control vane sets (31 & 32) are located aft of midships [underneath the aft shroud 5).

However, it is also contemplated that the fore-circumferential shroud (4) and the accompanying fore propulsor blade set (25) and the fore control vane sets (27 & 28) could all be situated substantially amidships, while the aft-circumferential shroud (5) and the accompanying aft propulsor blade set (29) and aft control vanes (31 & 32) could all be placed substantially aft of midships.

In one embodiment of the invention, as can be seen in both FIG. 2 and FIG. 6, cross-sectional views of the fore circumferential ring propulsor, fore-back-control vanes (11) are located behind the fore-propulsor blades (7). The position of the fore-back-control vanes (11) may be individually adjusted to direct the flow of water from the fore-propulsor blade (7) and control horizontal and vertical steering authority. As seen in FIG. 4, the perspective view of the fore circumferential ring propulsor and control assembly (2), in one embodiment of the invention, the fore-back-control vanes (11), that are individually connected by a fore-back control vane actuator (12), are located behind the fore-propulsor blades set (25) [formed from the collection of fore-propulsor blades (7)] and are substantially or completely within the fore-circumferential shroud gap (6) [as shown in FIGS. 2 and 6].

As can be seen in FIG. 3 and FIG. 7, cross-sectional views of the aft circumferential ring propulsor (3), in one of the embodiments of the invention, aft-front-control vanes (22) are located in front of the aft-propulsor blades (17), and are individually connected by the aft-front control vane actuator (23). As can be seen in FIG. 5, the perspective view of the aft circumferential ring propulsor and control assembly, in one embodiment of the invention, the position of the aft-front-control vanes (22) may be adjusted to direct the flow of water from the aft-propulsor blade set (29) [formed from the collection of aft-propulsor blades (17)] when it is reversed. As can be seen in FIG. 5 in conjunction with FIGS. 3 and 7, in one embodiment of the invention, the aft-front-control vanes set (32)) [formed from the collection of aft-front control vanes (22) and shown in FIG. 5] is situated substantially or completely within the aft-circumferential shroud gap (16) [as shown in FIGS. 3 and 7].

As can be seen in FIG. 2 and FIG. 6, cross-sectional views of the fore circumferential ring propulsor, in one of the embodiments of the invention, fore-front-control vanes (13) are located in front of the fore-propulsor blades (7), and are individually connected by the fore-front vane control actuator (14). As can be seen in FIG. 4, the perspective view of the fore circumferential ring propulsor and control assembly, in one embodiment of the invention, the position of the fore-front-control vanes (13) may be adjusted to direct the flow of water from the fore-propulsor blade set (25) [formed from the collection of fore-propulsor blades (7)] when it is reversed. As can be seen in FIG. 4 in conjunction with FIGS. 2 and 6, in one embodiment of the invention, the fore-front-control vanes set (28) [formed from the collection of fore-front control vanes (13), being individually connected by fore-front vane control actuator (14) and shown in FIG. 4] is situated substantially or completely within the fore-circumferential shroud gap (6) [as shown in FIGS. 2 and 6].

At least two placements for the fore drive assembly (15) and the aft drive assembly (24) are contemplated. The first one is where the power sources (33 & 34) and drive assemblies (15 & 24) are located within the underwater vehicle hull, as shown in FIGS. 6,7,8,9. The second embodiments is one where the power sources (33 & 34) and drive assemblies (15 & 24) are located in each of the two shrouds (4 & 5) driving its respective counter-rotating circumferential ring propulsors (2 & 3) as shown in FIGS. 2, 3, 4 and 5.

FIG. 6 is a cross-sectional view of the fore circumferential propulsor and control assembly wherein the fore power source (33) and fore drive assembly (15) are located within the underwater vehicle hull (1). FIG. 7 is a cross-sectional view of the aft circumferential ring propulsor and control assembly wherein the aft power source (34) and aft drive assembly (24) are located within the underwater vehicle hull (1).

Figure 8:
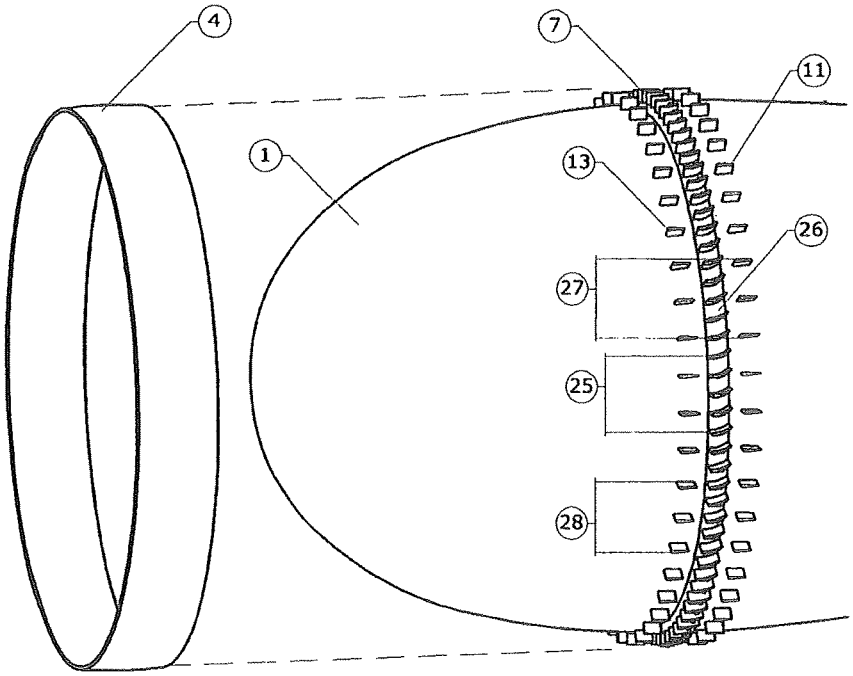
FIG. 8 is an exploded, perspective view of the fore circumferential ring propulsor and control assembly with the fore shroud offset in order to display the propulsor blades and control vanes that are mounted and controlled within the body of the underwater vehicle.

FIGS. 2, 4, and 6, show fore-back control vanes (11) located behind the fore-propulsor blades (7). As shown in FIG. 8, the position of the fore-back control vanes 11 [that constitute the fore-back control vane set (28)] may be adjusted to direct the flow of water from the fore-propulsor blade set (25) (made up of the group of fore-propulsor blades (7)] to control horizontal and vertical steering authority.

In one of the preferred embodiments, the individually adjustable control vanes (11, 13, 20 & 22) direct the flow of water from the propulsor blade sets (25 & 29) substantially at right angles to the cross-sectional radius of the underwater vehicle (1).

The respective drive assemblies (15 & 24), drive the fore and aft counter-rotating circumferential ring propulsors (2 & 3). As described in FIGS. 5, 6, 7, 8 and 9, the drive assemblies (15 & 24) may be located in the hull of the underwater vehicle (1).

The respective fore and aft drive assemblies (15 & 24) consists of the respective fore and aft power sources (33 & 34) and the hub (8 & 18) of each of the respective propulsor blade sets (25 & 29).

What is claimed is:

1. A propulsor system for an underwater vehicle having a hull, the system comprising:

a plurality of circumferential shrouds;

said plurality of circumferential shrouds having a fore-circumferential shroud and an aft-circumferential shroud;

said fore-circumferential shroud forming a fore-circumferential shroud gap between the fore-circumferential shroud and the hull;

said aft-circumferential shroud forming an aft-circumferential shroud gap between the aft-circumferential shroud and the hull;

fore-propulsor blades within the fore-circumferential shroud gap between the fore-circumferential shroud and the hull;

said fore-propulsor blades forming a fore-propulsor blade set;

aft-propulsor blades within the aft-circumferential shroud gap between the aft-circumferential shroud and the hull;

said aft-propulsor blades forming an aft-propulsor blade set; and aft-back control vanes located behind the aft-propulsor blades wherein the position of the aft-back-control vanes may be individually adjusted to direct the flow of water from the aft-propulsor blade set and control horizontal and vertical steering of the underwater vehicle, wherein said fore-propulsor blades and said aft-propulsor blades rotate in opposite directions when the underwater vehicle is moved in forward or reverse and in the same direction to move water in opposing directions to enable maneuvering of the underwater vehicle while hovering.

2. The propulsor system for an underwater vehicle of claim 1 wherein said aft-back-control vanes located behind the aft-propulsor blades are set within the aft-circumferential shroud gap.

3. The propulsor system for an underwater vehicle of claim 2 wherein:

said fore-circumferential shroud is substantially annular;

said aft-circumferential shroud is substantially annular;

said fore-circumferential shroud gap between the fore-circumferential shroud and the hull is substantially annular; and said aft-circumferential shroud gap between the aft-circumferential shroud and the hull is substantially annular.

4. The propulsor system for an underwater vehicle of claim 3 further comprising fore-back-control vanes located behind the fore-propulsor blades and wherein the position of the fore-back-control vanes may be individually adjusted to direct the flow of water from the fore-propulsor blade and control horizontal and vertical steering of the underwater vehicle.

5. The propulsor system for an underwater vehicle of claim 4 wherein said fore-back-control vanes located behind the fore-propulsor blades are set within the fore-circumferential shroud gap.

6. The propulsor system for an underwater vehicle of claim 5 further comprising aft-front-control vanes located in front of the aft-propulsor blades and wherein the position of the aft-front-control vanes may be individually adjusted to direct the flow of water from the aft-propulsor blade set when the underwater vehicle is reversing and said aft-front-control vanes are set within the aft-circumferential shroud gap.

7. The propulsor system for an underwater vehicle of claim 6 further comprising fore-front-control vanes located in front of the fore-propulsor blades and wherein the position of the fore-front-control vanes may be individually adjusted to direct the flow of water from the fore-propulsor blade set when the underwater vehicle is reversing and said fore-front-control vanes are set within the fore-circumferential shroud gap.

8. The propulsor system for an underwater vehicle of claim 7 wherein said fore-propulsor blades and said aft-propulsor blades rotate in opposite directions.

9. The propulsor system for an underwater vehicle of claim 8 wherein said fore-circumferential shroud is situated forward of midship of the underwater vehicle and said aft-circumferential shroud is situated aft of midship of the underwater vehicle.

10. The propulsor system for an underwater vehicle of claim 9 wherein said fore-propulsor blades within the fore-circumferential shroud gap are driven by a drive assembly located within the fore-circumferential shroud and said aft-propulsor blades within the aft-circumferential shroud gap are driven by a drive assembly located within the aft-circumferential shroud.

11. The propulsor system for an underwater vehicle of claim 8 wherein said fore-circumferential shroud is situated substantially midship of the underwater vehicle and said aft-circumferential shroud is situated aft of midship of the underwater vehicle.

12. The propulsor system for an underwater vehicle of claim 1 further comprising fore-back-control vanes located behind the fore-propulsor blades wherein the position of the fore-back-control vanes may be individually adjusted to direct the flow of water from the fore-propulsor blade set to control horizontal and vertical steering of the underwater vehicle.

13. A propulsor system for an underwater vehicle having a hull, the system comprising:

two shrouds joined to the hull of the underwater vehicle each forming an annular gap between the hull and the shrouds;

two counter-rotating circumferential ring propulsors each with a set of blades, wherein the set of blades of one of the propulsors is positioned within one of the annular gaps formed by one of the shrouds and the set of blades of the other of the propulsors is positioned within the other of the annular gaps formed by the other of the shrouds, wherein the blades of the two propulsors are in a fixed position mounted on hubs; and two sets of individually adjustable control vanes, wherein each of the two sets of vanes is located in the annular gaps behind respective ones of the two set of propulsor blades directing the flow of water from the blade sets substantially at right angles to the hull of the underwater vehicle, wherein the set of blades of the one of the propulsors and the set of blades of the other of the propulsors rotate in opposite directions when the underwater vehicle is moved in forward or reverse and in the same direction to move water in opposing directions to enable maneuvering of the underwater vehicle while hovering.

14. The propulsor system for an underwater vehicle of claim 13 wherein one of the two counter-rotating circumferential ring propulsors is located fore of midship of the underwater vehicle and the other of the two counter-rotating circumferential ring propulsors is located aft of midship of the underwater vehicle.

15. The propulsor system for an underwater vehicle of claim 13 wherein the individually adjustable control vanes are located in front of each of the respective two propulsor blade sets within the annular gaps.

* * * * *